United States Patent [19]

Prunier

[11] 3,951,203

[45] Apr. 20, 1976

[54] UNIVERSAL LENS BLOCKING FIXTURE

[75] Inventor: Louis J. Prunier, Charlton, Mass.

[73] Assignee: American Optical Corporation, Southbridge, Mass.

[22] Filed: Dec. 16, 1974

[21] Appl. No.: 532,789

[52] U.S. Cl. ..... 164/334; 51/124 L; 164/112; 249/91; 425/808

[51] Int. Cl.[2] ..... B22D 19/00

[58] Field of Search ..... 164/112, 334; 425/412, 425/183, 127, 808; 249/83, 91; 51/124 L, 277

[56] References Cited

UNITED STATES PATENTS

| | | | |
|---|---|---|---|
| 3,049,766 | 8/1962 | Buckminster | 164/4 |
| 3,166,027 | 1/1965 | Spenzel | 425/183 |
| 3,195,197 | 7/1965 | Prunier | 425/808 |
| 3,221,378 | 12/1965 | Faas et al. | 164/334 |
| 3,330,331 | 7/1967 | Duckwall et al. | 164/112 |
| 3,354,938 | 11/1967 | Carigan et al. | 164/150 |
| 3,563,301 | 2/1971 | McCall | 425/808 |
| 3,724,803 | 4/1973 | Goldfarb | 425/183 |

*Primary Examiner*—Francis S. Husar
*Assistant Examiner*—Carl Rowold
*Attorney, Agent, or Firm*—H. R. Berkenstock, Jr.; William C. Nealon

[57] ABSTRACT

A fixture for blocking lenses of various diametral sizes with cast blocks of corresponding diametral sizes using a single annular support of fixed diameter for all lenses as a reference relative to which pressure used in clamping of the lenses for blocking may be regulated to prevent lens distortion despite variations in their diametral sizes.

9 Claims, 7 Drawing Figures

UNIVERSAL LENS BLOCKING FIXTURE

BACKGROUND OF THE INVENTION

1. Field of the Invention

This invention relates to lens blocking apparatuses and has particular reference to improvements in block casting fixtures.

2. Description of the Prior Art

In the blocking of lenses, particularly of the type formed of optical resins and commonly referred to as "plastic" lenses, difficulties have arisen from a need to meet at least two major requirements. These are: that despite variations in diametral sizes of lenses to be blocked, the blocks must in each case extend nearly from edge-to-edge for full surface support and prevention of lens warpage, fracturing or other damage during subsequent surface grinding and/or polishing operations; and that clamping forces applied to the lenses during blocking be adequate for secure holding purposes but otherwise minimal and so geometrically applied to the lenses, regardless of their diametral size, as to avoid distortion or other damaging of the lenses.

Corollary to the foregoing is the need to minimize the volume of blocking material used in each operation for heated metallic alloy or similar heated blocking operations so as to avoid lens warpage by overheating from the blocking medium.

In blocking lenses by the block casting technique, e.g. with a relatively low melting temperature metal alloy which is now widely used in the art, the aforesaid problems of avoiding lens warpage or other damage during blocking and working have hitherto been at least partially, but far less than efficiently, overcome by the provision of differently and separately designed and/or proportioned blocking fixtures for differently sized or diametrically dimensioned lenses. This requirement for the manufacture and supplying of a plurality of blocking fixtures for use with each lens blocker and their usual individual ungainliness and costliness, not to mention time spent in interchanging these fixtures during use of a blocker, renders such prior art blocking systems unduly expensive, ungainly, awkward and tedious to use and generally of less than optimum efficiency and/or efficacy.

It is, accordingly, a principal object of this invention to overcome the aforesaid and related problems and deficiencies in the field of lens blocking and more particularly in the area of in situ block casting operations.

SUMMARY OF THE INVENTION

The present invention accomplishes the aforesaid objective and its corollaries by providing a blocking fixture which is universal in its adaptability to the blocking of lenses of various diametral sizes with cast blocks of correspondingly different sizes which are formed in situ and without distortion of the lenses despite the differences of lens diameters.

The fixture employs a single annular lens support of a fixed diameter for receiving lenses of all sizes. The single support provides a reference relative to which the force, direction and actual geometrical location of clamping forces may be regulated for accomplishing a secure holding effect but without distorting or placing undue strain upon the lenses regardless of their diametral sizes.

In furthering the universality of the fixture, more particularly with respect to the aforementioned need to block lenses with surface support nearly from edge-to-edge in all diametral directions, interchangeable annular casting gaskets are included in the fixture make up.

These gaskets form the outer walls of the fixture casting cavity. They are snugly but readily interchangeably telescopically fitted over the annular lens support and have upper inside diameters of the size required for casting blocks nearly from edge-to-edge in all diametrical directions across the lenses. The uppermost inside casting diameter of these gaskets, each one of each gasket being preselected according to the diametral size of lenses to be blocked therewith, may range from the outer diametral size of the annular lens support, e.g. 50 mm, to several millimeters larger, e.g. 70 mm, for blocking lenses of from 50 mm to 71 mm in diameter or larger.

Gaskets of various larger or smaller casting diameters may be used within the scope of the invention. Those most commonly used to meet present day demands of lens sizes, however, would be two in number, one having an uppermost inside casting diameter of approximately 50 mm and the other approximately 70 mm. Alternately, a single reversible gasket may be provided as a substitute for the aforesaid two or any other preselected pair of gaskets as will become apparent hereinafter.

Details of the invention will be more readily understood by reference to the following description taken in conjunction with the accompanying drawings.

IN THE DRAWINGS

DESCRIPTION OF THE PREFERRED EMBODIMENTS

Figure 1:
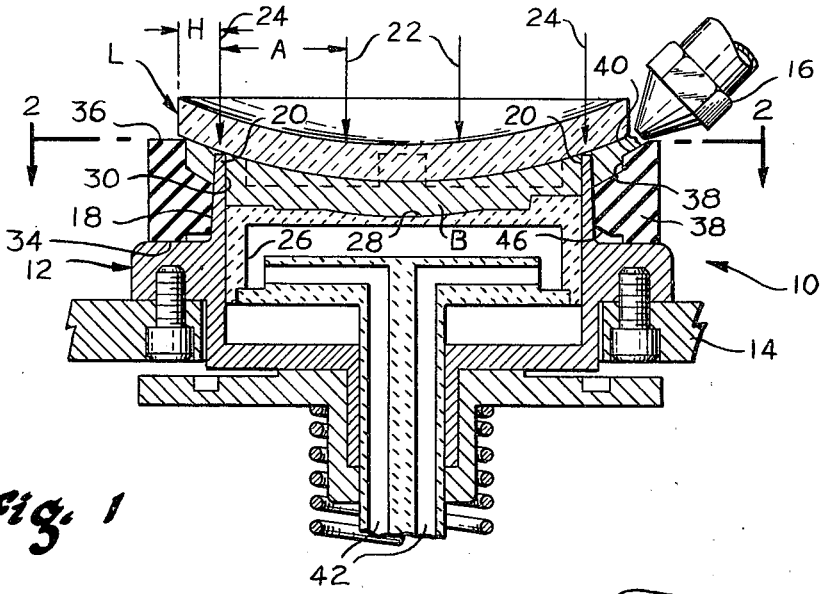
FIG. 1 is a vertical cross-sectional view of a preferred embodiment of the invention.

Blocking fixture 10 of FIGS. 1 and 2 comprises a main supporting base 12 which, when in a position of use, is bolted or otherwise secured to a platform 14 of a lens blocker having a nozzle 16 through which a liquified lens block forming medium may be dispensed into fixture 10 as will be described in detail shortly.

Since the present invention relates to improvements in block casting fixtures, only platform 14 and nozzle 16 of the aforesaid blocker have been illustrated in the drawings. Those interested in structural and/or other details of an exemplary blocker may refer to U.S. Pat. No. 3,354,938. It should be understood, however, that beyond the requirement for a mounting platform 14 and means such as nozzle 16 for dispensing a liquified block forming medium, all embodiments of the present invention are adaptable to various other lens blocking apparatuses. U.S. Pat. No. 3,354,938 is referred to only for purposes of illustration.

Base 12 of fixture 10 is provided with an upstanding annular lens support 18 having a hollow interior of a fixed diametral size. Support 18 may be cast, machined or otherwise formed integrally with base 12 as shown or, alternatively, separately cast and/or machined and bolted, welded or otherwise fixed to base 12. In either case, support 18 is upwardly terminated with four equally circumferentially spaced lens receiving fingers 20. Three or more than four fingers may be provided if desired.

Annular support 18 preferably being of from 1 mm to 4 mm in thickness has a maximum internal diametral dimension less than the outer diametral dimension of the smallest lens intended to be blocked in fixture 10. Thus, the fixture is adaptable to use in the blocking of lenses of all normally encountered sizes. Marginal portions of the lenses will overhand support 18 by amounts according to the differences between their diametral sizes and that of the support.

Being of fixed size, lens support 18 provides geometrical reference points (fingers 20) relative to which a lens clamp such as that illustrated in U.S. Pat. No. 3,354,938 may be placed against a lens L of FIG. 1 or any other lens similarly seated upon fingers 20. Thus, for a given minimum thickness of material of a lens to be clamped, it becomes possible to regulate the clamping forces applied in the directions and at points indicated by arrows 22, for example, so that such clamping forces will securely hold lens L in place for blocking yet be less than that which would cause distortion of lens L by the lever arm A effect.

This particular clamping force, once established, can thereafter be applied to all lenses intended to be blocked in fixture 10 which are of approximately the same or greater thickness of material, despite their diametral size, i.e. despite the extent of their overhand H (FIG. 1).

Substantially complete avoidance of lens warpage by clamping forces applied thereto in fixture 10 can, however, be accomplished by applying such clamping forces directly over fingers 20 of lens support 18 as indicated by arrows 24 (FIG. 1). By so geometrically locating the clamping forces used to hold a lens L in place during blocking, control of the force or pressure applied becomes much less critical. These clamping forces, however, must be maintained below that which would cause crushing of the lens or marring of either of its surfaces.

Internally of base 12 is piston 26, the upper surface 28 of which is contoured according to the shape desired of the upper surface of a lens block B intended to be cast within fixture 10. Piston 26 is selectively adjustable toward and away from fingers 20 for purposes of adjusting the depth of mold cavity 30. This adjustment may be used to control the center thickness of a block B cast in cavity 30 so as to provide block B with a thickness and volume of blocking material which is substantially no greater than that required to support the lens against warpage or other distortion during surface grinding and/or polishing of its unblocked opposite side.

With respect to the latter requirement for adequate support against lens distortion, it is a principal objective of this invention to provide in all cases, a block which extends nearly to the outermost edges of the lens, regardless of the diametral size of the lens. This is accomplished with interchangeable and/or reversible casting gaskets, one of which is illustrated in FIG. 1 as gasket 32. These gaskets have hollow interiors which form the outer walls of mold cavity 30 generally as illustrated in the one example of FIG. 1.

Gasket 32 is preferably formed of a relatively rigid but resilient material, e.g. rubber or plastic, which will conform readily to the surface shape of glass or plastic lenses to be blocked and form a tight seal thereagainst without marring these surfaces. The gasket is so internally contoured adjacent its lowermost end 34 as to fit snugly but slideable about lens support 18. Its opposite uppermost end 36, however, is internally relieved in juxtaposition with fingers 20 so as to extend mold cavity 30 peripherally outwardly beyond lens support 18 and to a point adjacent the outermost edges of lens L. The relief 38 in gasket 32 forms the outermost annular wall of mold cavity 30. A narrow channel 40 formed across gasket 32 (FIGS. 1 and 2) provides an inlet to cavity 30 through which a liquified casting medium such as a low melting temperature metal alloy may be poured into cavity 30 by means of nozzle 16.

Figure 2:
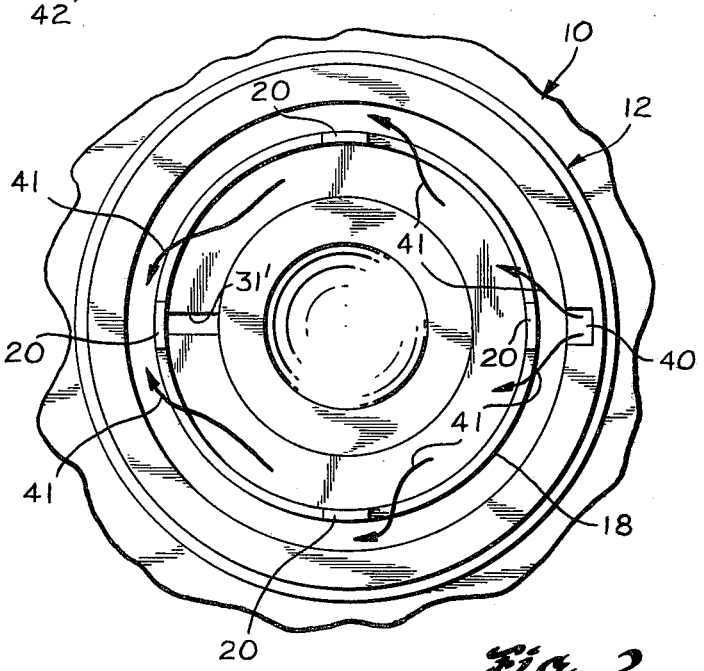
FIG. 2 is a cross-sectional view taken generally along line 2—2 of FIG. 1.
Figure 5:
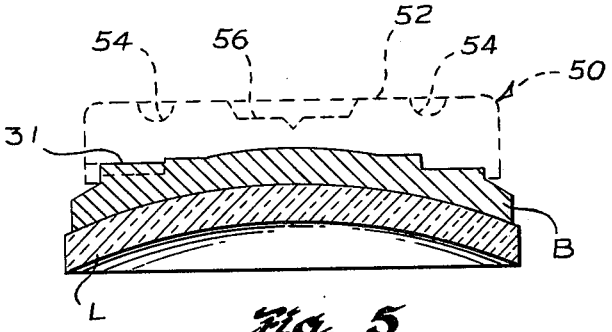
FIG. 5 is a cross-sectional view of an exemplary blocked lens produced according to the embodiment of the invention shown in FIG. 1.

The blocking of lens L is accomplished by filling mold cavity 30 with the low melting temperature metal alloy which, upon entering cavity 30 from inlet 40, will flow around fingers 20 as indicated by arrows 41 in FIG. 2 and thereby fill the relief area 38 to complete the block B which is shown in both of FIGS. 1 and 5.

Following the filling of cavity 30 with the heat liquified blocking medium, it may be quickly solidified by the passage of a coolant such as water into piston 26 through passageways 42 (FIG. 1). Upon solidification of block B, lens L is lifted off of support 18, carrying block B with it.

It is pointed out that the blocking of lens L in FIG. 1 is intended to be illustrative of dealing with a relatively large lens according to the invention wherewith the block B extends outwardly beyond lens support 18, i.e. nearly to the edges of lens L.

Figure 3:
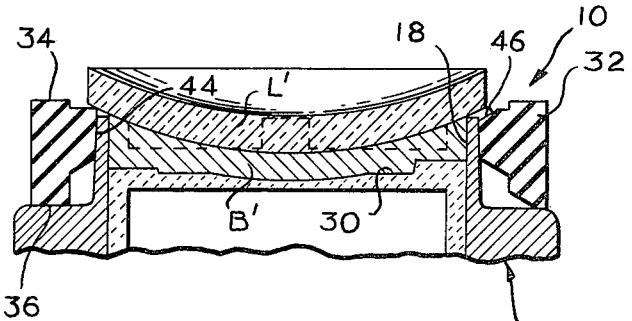
FIG. 3 is a fragmentary cross-sectional view of the block casting fixture of FIG. 1 showing an alternative arrangement of mold components.
Figure 4:
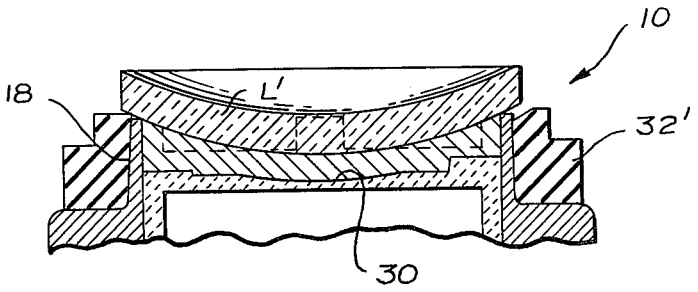
FIG. 4 illustrates a modification of the block casting fixture of FIGS. 1 and 2.

The blocking of smaller lenses such as lenses L′ or L″, FIGS. 3 and 4 respectively, is accomplished according to the invention with the same annular lens support 18 and base 12 by simply removing, inverting and replacing gasket 32 as shown in FIG. 3 or by substituting a similarly functioning gasket 32′ as shown in FIG. 4.

In the FIG. 3 concept of rendering fixture 10 adaptable to blocking similar lenses L′, the inverting of gasket 32 positions its former lower end 34 now upwardly for receiving lens L′ and its former upper end 36 having relief 38 now downwardly out of use against base 12. Thus, the inner smaller diameter wall 44 of gasket 32 now forms the outermost wall of mold cavity 30, locating this outer wall adjacent the edge of lens L′. Thus, a block cast in situ upon lens L′ will extend nearly from edge-to-edge over the lens. Groove 46 in gasket 32 at end 34 thereof provides a passageway through which the liquified blocking medium may be dispensed into cavity 30 to form block B′.

As an alternative to the use of the invertible gasket 32, a gasket 32′ of L-shape cross-section (FIG. 4) may be used to form the outer wall of mold cavity 30 for the blocking of lens L′. The result of this alternative would be the casting in situ of a block B′ upon lens L′, i.e. producing the work product illustrated in FIG. 6.

It is to be understood that lens L′ is intended to be clamped against support 18 in the manner described in connection with lens L of FIG. 1. The identical lens support 18 is used in all cases wherein, with or without the lens overhang H of lens L, identical lens clamping forces and positions of application thereof may be, and are preferably, used.

The universality of fixture 10 results at least in part from its having a single annular lens support for use with lenses of all sizes and wherewith the clamping force and geometrical application thereof may be standardized, together with provision for the casting of blocks from approximately edge-to-edge of all lenses, regardless of their diametral dimensions.

While it is preferable when blocking plastic lenses to provide blocks such as B or B′ (FIGS. 5 and 6 respectively) which are of sufficient but minimal thickness to support lenses L or L′ against warpage, it should be understood that much thicker blocks such as block B″ (FIG. 7) may be cast with fixture 10 if desired, simply by lowering piston 26 further into base 12. Also, since a purpose for blocking lenses according to the invention is to provide such lenses with holding means for adapting the lenses to lens surfacing apparatuses, the upper surface 28 of piston 26 may be provided with a shape corresponding to that of surface 48 of block B″. Alternatively, separate steel or cast iron caps 50 having similar upper surfaces 52 may be provided for use with the thinner cast blocks B and/or B′. Caps 50 are shown with broken line illustration in FIGS. 5 and 6. In conjunction with the use of caps 50, a key 31 is formed on blocks cast in mold cavity 30. This is accomplished with a recess 31′ in the upper surface of piston 26 (FIG. 2). Adaptors 50 are provided with keyways 31″ which fit over keys 31′ preventing relative rotational movement between the blocked lenses and adaptors 50 during lens surfacing operations.

As it is well-known in the art, recesses such as 54 and/or 56 in the upper surfaces of blocks are used to maintain meridional alignment of the blocked lenses relative to surfacing tools and also serve as sockets for receiving drive pins which initiate oscillational and/or other movements of the lenses over the surfacing tools.

Figure 6:
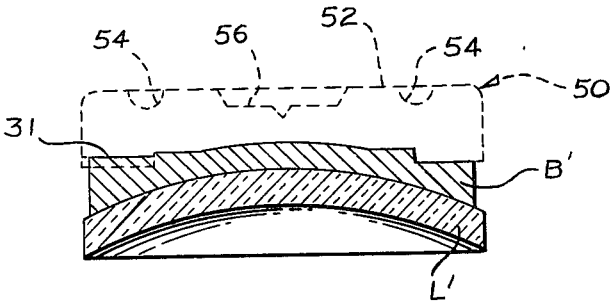
FIG. 6 is a cross-sectional view of an exemplary blocked lens produced according to the embodiment of the invention shown in FIG. 4.
Figure 7:
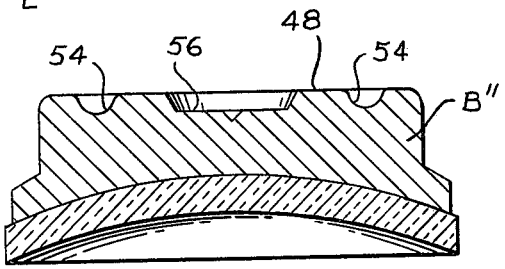
FIG. 7 illustrates, in cross-section, a modified form of lens block which may also be produced according to the invention.

Those interested in details of such lens surfacing operations and apparatuses and the use of blocks and/or adaptors of types illustrated in FIGS. 5, 6 and 7 may refer to U.S. Pat. No. 2,916,857.

I claim:

1. A fixture for blocking lenses comprising:

a cylindrical base;

an upstanding annular lens support on said base terminating with a plurality of circumferentially spaced lens supporting fingers, said support having a hollow interior of a maximum internal diametral dimension which is less than the minimum outer diametral size of a lens to be blocked;

an annular gasket having a hollow interior of a diametral size adjacent a first of its ends adapted to fit snugly but readily removably about said lens support, the hollow interior of said gasket adjacent its opposite second end being at least partially exposed in juxtaposition with said lens supporting fingers as an upper portion of an outer wall of a block casting cavity formed within said fixture when said gasket is fitted upon said annular lens support, the inner diameter of said upper portion being less than the minimum outer diameter of a lens to be blocked, a portion of said lens support beneath said fingers completing said outer wall of said casting cavity; and means forming a casting cavity bottom within said lens support, said cavity being closed and defined on one side by said lens when placed upon said upstanding support and on all other sides by said gasket and cavity bottom, said gasket further having an open channel adjacent one of its ends forming an inlet to said cavity for use in dispensing a block forming medium thereinto.

2. A blocking fixture according to claim 1 wherein said hollow interior of said removable gasket adjacent said second end thereof is spaced outwardly away from said lens supporting fingers and wherewith said upper portion of said outer wall of said casting cavity formed thereby is of greater diametral dimension than the outer diametral dimension of said annular lens support.

3. A blocking fixture according to claim 1 wherein said hollow interior of said removable gasket adjacent said second end thereof is positioned against said lens supporting fingers and wherewith said upper portion of said outer wall of said casting cavity formed thereby is of approximately the same diametral dimension as that of said annular lens support.

4. A blocking fixture according to claim 1 wherein said annular gasket is replaceable and a replacement comprises an annular gasket having a hollow interior of a uniform diametral size adapted to fit snugly but readily removeably about said lens support.

5. A blocking fixture according to claim 1 wherein said lens supporting fingers are four in number.

6. A blocking fixture according to claim 1 wherein said lens supporting fingers are three in number.

7. A blocking fixture according to claim 1 wherein said means for forming a casting cavity bottom comprises a piston within said base internally of said lens support, said piston having an upper surface forming said bottom of said casting cavity and wherewith the depth of said casting cavity may be adjusted by movement of said piston.

8. A blocking fixture according to claim 1 wherein said cavity bottom includes preformed protrusions for producing axis aligning and block actuating sockets in blocks cast within said cavity.

9. A fixture for blocking lenses comprising:

a cylindrical base;

an upstanding annular lens support on said base terminating with a plurality of circumferentially spaced lens supporting fingers, said support having a hollow interior of a maximum internal diametral dimension which is less than the minimum outer diametral size of a lens to be blocked;

an annular gasket having a hollow interior of a diametral size adjacent a first of its ends adapted to fit snugly but readily removably about said lens support, the hollow interior of said gasket adjacent its opposite second end being at least partially exposed in juxtaposition with said lens supporting fingers as an upper portion of an outer wall of a block casting cavity formed within said fixture when said gasket is fitted upon said annular lens support, said second end of said gasket being spaced outwardly away from said lens supporting fingers and wherewith said upper portion of said outer wall of said casting cavity formed thereby is of greater diametral dimension than the outer diametral dimension of said annular lens support and said gasket further being invertible and replaceable upon said support for locating, when inverted, said first of its ends adjacent said lens supporting fingers in snugly fitted relationship thereagainst thereby rendering said upper portion of said outer wall of said casting cavity of approximately the same diametral dimension as that of said annular lens support.

* * * * *